United States Patent [19]

Cho

[11] Patent Number: 4,458,226

[45] Date of Patent: Jul. 3, 1984

[54] NON-CONTACT DIRECTION CONTROLLER

[75] Inventor: Chih M. Cho, Taipei, Taiwan

[73] Assignee: Matahari International Corp., Taipei, Taiwan

[21] Appl. No.: 461,772

[22] Filed: Jan. 28, 1983

[51] Int. Cl.[3] ..... H01H 36/00

[52] U.S. Cl. ..... 335/205; 335/206; 335/207

[58] Field of Search ..... 200/6 A, 153 K; 74/471 XY; 335/205, 206, 207, 153; 338/128; 340/365 L, 709; 307/119

[56] References Cited

U.S. PATENT DOCUMENTS

| | | | |
|---|---|---|---|
| 3,114,020 | 12/1963 | Hall | 335/207 |
| 4,137,512 | 1/1979 | Sidor | 335/206 |
| 4,187,483 | 2/1980 | Whitney | 335/206 |

*Primary Examiner*—J. D. Miller
*Assistant Examiner*—J. Sterett
*Attorney, Agent, or Firm*—Krass & Young

[57] ABSTRACT

A manually actuatable direction controller includes a planar base supporting a number of magnetic reed switches, one of each direction in which control is to be exercised. The reed switches are arrayed about the plane of the base in a symmetrical pattern, with each one positioned in the direction over which it exercises control. A number of permanent magnets are arrayed in one-to-one relationship with the reed switches, with the magnets lying in a plane spaced from and parallel to the switch plane. A sheet of magnetically conductive material is supported for movement in the base between the plane of the switches and the plane of the magnets. An elongated handle has one end connected to the center of the sheet and projects normally from the base. The magnetic field imposed by each permanent magnet on its associated reed switch maintains that switch in a first state. By motion of the handle the magnetically conductive sheet can be moved with respect to any magnet and its associated switch, diverting the magnetic field of the magnet and thereby causing the associated reed switch to change state and effect the control signal provided to an associated direction controller.

4 Claims, 2 Drawing Figures

NON-CONTACT DIRECTION CONTROLLER

DESCRIPTION

1. Technical Field

This invention relates to manually actuable controllers of the "joy stick" type for generating control signals for an associated directional drive system which causes the drive to move a controlled object, or an element on a video display, in a direction corresponding to motion of the controller handle and more particularly to such a controller having a single output switch for each direction in which control is to be exercised.

2. Background Art

Manually actuable direction controllers have heretofore been used to control the position of a physical output device or to generate control signals for modifying the position of a display element, such as a cursor on the video display. One class of such controllers includes an array of switches with one switch positioned in each direction over which control may be exercised. If motion of the driven element can be controlled along a single axis, in each direction, there will be two switches; if motion can be controlled in either direction along two perpendicular axes, there will be four switches; etc.

To the applicant's knowledge these switch-type motion controllers have heretofore employed manually actuable micro-switches, typically employing a stress buffer spring between the manually actuable element and the micro-switch.

The main defect of this type of contact type control switch is that the switches are delicate and susceptible to mechanical damage; the springs have a limited working life because of fatigue induced by their constant elastic stressing; and the bounce time of mechanical switch elements limits the frequency at which the switch can be turned on and off. Additionally, the mechanical elements which support the controlling handle will wear with use and make the handle difficult to actuate.

Disclosure of the Invention

The present invention is directed toward a switching direction controller of this type which obviates the disadvantages of the contact type controller by employing magnetic reed switches as the output elements and a unique and simple magnetic diversion circuit to achieve controlled closure of the switches in response to mechanical actuation of the handle.

The present invention broadly employs a number of reed switches, one for each direction in which control is to be achieved arrayed in a symmetrical planar configuration with each switch disposed in a position related to the direction of motion that it controls. An array of permanent magnets, one for each reed switch, are supported in a plane slightly separated from the switches, with each magnet being closely spaced from an associated switch. A rigid sheet of magnetically conductive material is supported between the switches and the magnets with its plane parallel to the switch and magnet arrays. A handle is attached to the center of the magnetically conductive sheet and projects normally to the sheet. The handle may be manually manipulated to move an edge of the sheet between any reed switch and its associated magnet.

The magnetic fields surrounding each permanent magnet normally maintain their associated limit switches in a first condition, either opened or closed.

When the sheet is moved so that its edge is interposed between a magnet and its associated reed switch, the magnetic lines of force are diverted through the sheet and do not reach the reed switch and the reed switch reverses condition, going from its normal condition to its actuated condition. In this manner a control output can be varied without contact with the switches and the entire assembly requires only a single moving part.

Magnetic reed switches having their moving parts isolated from the atmosphere and mechanical contact have extremely long lives and upon proper alteration of the imposed magnetic forces they switch instantly allowing a high frequency of actuation and deactuation.

BRIEF DESCRIPTION OF THE DRAWINGS

The description makes reference to the accompanying drawings in which.

Figure 1:
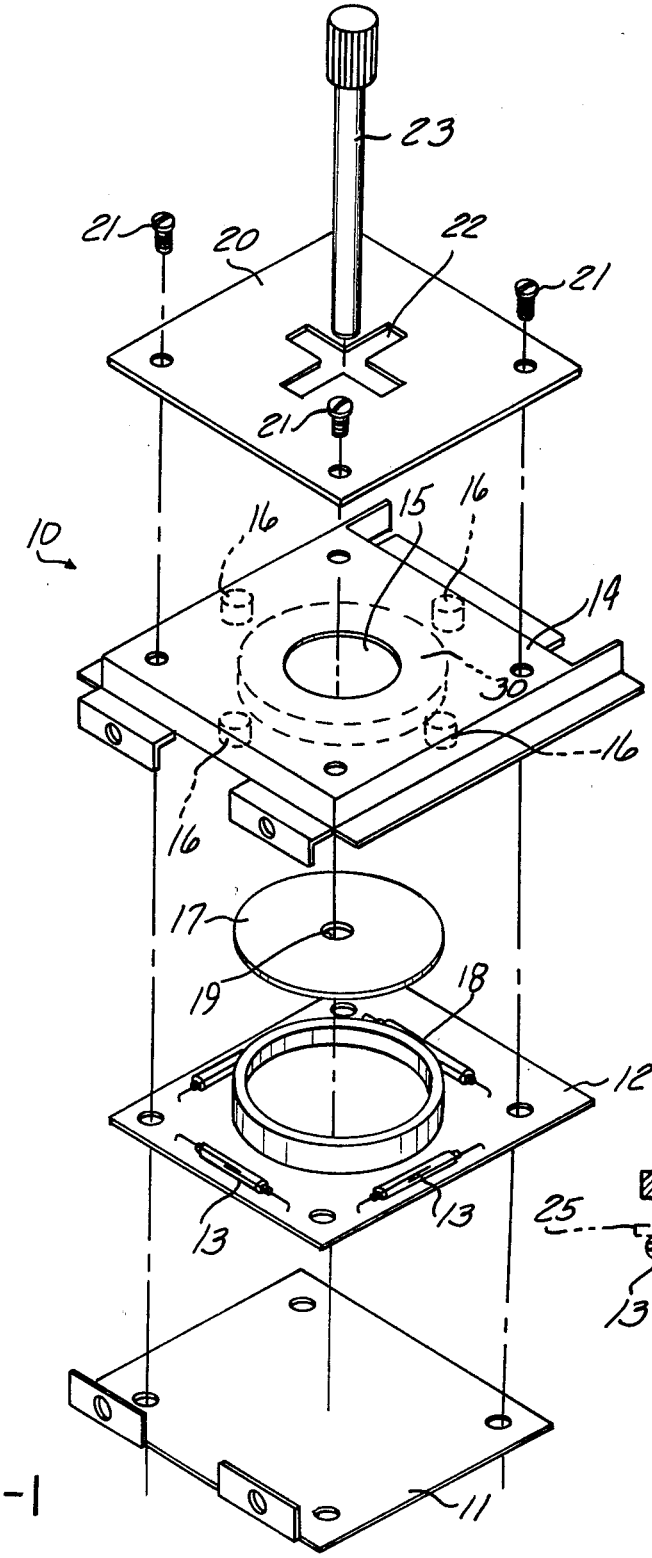
FIG. 1 is an exploded perspective view of a non-contact direction controller representing a preferred embodiment of the invention.

Referring to the drawings, the controller representing the preferred embodiment of the invention, generally indicated at 10, employs a base plate 11, preferably formed of a plastic or other magnetically non-conductive material, which supports a planar plastic circuit board 12. The preferred embodiment of the invention is adapted to generate switching control signals representative of motion in either direction along two mutually perpendicular axes; i.e., motion in the direction of any of four quandrants in a plane. Accordingly, the circuit board 12 supports four magnetic reed switches 13 disposed in a rectangular array. Each direction drive circuit (not shown) is controlled by one of the magnetic reed switches 13.

The controller assembly further includes a planar upper cover 14 adapted to overlie the circuit board 12 and engage the base plate 11. The upper cover 14 has a central hole 15 having an annular ring seat 30 formed about its lower edge. The underside of the cover 14 also supports four small permanent magnets 16 arrayed in a quadrant pattern having the same spacing as the reed switches 13 so that when the assembly is closed each magnet 16 closely overlies one of the reed switches 13.

A circular rigid sheet of magnetically conductive material 17, having a diameter slightly larger than the distance between a pair of opposed reed switches 13 is supported beneath the ring seat 30 and above a mating ring seat 18 which projects upwardly from the center of the circuit board 12, centered about the mid-point of the array of switches 13. The disc 17 is preferably formed of a paramagnetic material such as aluminum and has a central threaded hole 19.

A top shell plate 20 is adapted to be supported on top of the upper cover 14. The assembly of the shell plate 20, the cover plate 14, the circuit board 12 and the base plate 11 are secured together by screws 21 that pass through corner holes in each of the units and preferably thread into the holes in the base plate 11. The disc 17 is sandwiched in this assembly between the upper ring seat 30 and the lower ring seat 18.

The shell plate 20 has a cross-shaped groove 22 formed in its center. An elongated actuator handle passes through the groove and has its lower end threaded within the central hole 19 in the magnetically conductive sheet 17.

Figure 2:
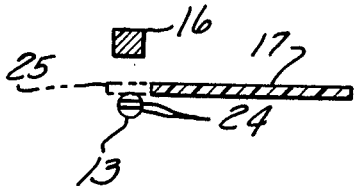
FIG. 2 is a schematic view of a reed switch and magnet pair illustrating the action of the magnetic disc to modify the influence of a magnet on the reed switch.

The handle may be moved with respect to the base assembly along the lines of the groove 22. When the handle is positioned at the mid-point of the groove, the disc 17 is centered about the array of limit switches 13 so that the edge of the disc is interposed between each of the reed switches 13 and its associated permanent magnet 16. FIG. 2 illustrates the relationship of one of the reed switches 13, its associated magnet 16, and the edge of the disc 17. The contacts of the reed switch 13 are designated by the numeral 24.

When the edge of the disc 17 is interposed between the magnet 16 and its associated reed switch 13, the magnetic lines of flux from the magnet are shunted by the paramagnetic material of the disc so that the magnetic field of the magnet does not influence the reed switch 13. The reed switch 13 is then in its open position. This position of the disc is illustrated by the numeral 25. When the disc 17 is moved away from one of the reed switches, by manipulation of the handle 23, the reed switch is subjected to the field of the magnet 16 and goes to its closed position. In alternative embodiments of this invention the closed and open positions could be alternated.

When the reed switch is so actuated it energizes an associate driving circuit (not shown) to move the driven element in a direction corresponding to the motion of the handle 23. When the handle 23 is at the mid-point of the groove 22, each of the reed switches 13 is shielded from the magnetic field of its associated magnet 16 by an edge of the disc 17 and no drive signals are generated. In alternative embodiments of the invention the disc 17 could be sized so that when it is at its central position its edges do not extend between any of the magnet/reed switch sets.

In alternative embodiments of the invention a larger number of reed switches, magnets and groove elements could be provided to control motion along the larger number of axes.

I claim:

1. A direction controller including:

a base plate;

a plurality of magnetic reed switches arrayed in a symmetrical pattern about the base plate;

a cover plate supported above the base plate;

a plurality of permanent magnets supported on the cover plate in the same pattern as the array of magnetic reed switches so that there exists a one-to-one relationship between a magnet and a reed switch;

a magnetic conductive sheet supported between the base plate and the cover plate so as to allow motion in the plane of the sheet; and an elongated handle projecting normally to the magnetic conductive sheet and having one end fixed thereto so that motion of the handle moves the magnetic conductive sheet in its plane, whereby the magnetic conductive sheet may be interposed between selected magnets and their associated reed switches to control the conductive condition of the reed switches.

2. The direction controller of claim 1 wherein the magnetic conductive sheet constitutes a disc having a diameter at least equal to the distance between a diametrically opposed pair of reed switches in the array and the magnetic disc is supported for motion through a distance sufficient to remove its edge from a line between one of the magnets and its associated reed switch.

3. The direction controller of claim 1 wherein said magnetic conductive sheet is formed of a paramagnetic material.

4. The direction controller of claim 1 including an annular ring seat formed on the cover plate and a second annular ring seat formed on the base plate, the ring seats sandwiching the magnetic sheet.

* * * * *